US006398938B2

(12) United States Patent
Merk et al.

(10) Patent No.: US 6,398,938 B2
(45) Date of Patent: Jun. 4, 2002

(54) PROCESS FOR ELECTROCHEMICAL OXIDATION OF ORGANIC COMPOUNDS

(75) Inventors: Claudia Merk, Limburgerhof; Günther Huber, Ludwigshafen, both of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/742,537

(22) Filed: Dec. 22, 2000

(30) Foreign Application Priority Data

Dec. 22, 1999 (DE) ..... 199 62 102

(51) Int. Cl.[7] ..... C25B 3/00; C25B 3/08

(52) U.S. Cl. ..... 205/413; 205/422; 205/431; 205/434; 205/440; 205/441; 205/450; 205/460

(58) Field of Search ..... 205/413–463

(56) References Cited

U.S. PATENT DOCUMENTS

| | | | | |
|---|---|---|---|---|
| 4,496,440 A | * | 1/1985 | Campbell et al. | 204/78 |
| 4,639,298 A | | 1/1987 | Kreh et al. | 204/59 R |
| 4,794,172 A | | 12/1988 | Kreh | 534/15 |

FOREIGN PATENT DOCUMENTS

| | | |
|---|---|---|
| DE | 199 11 746 | 9/2000 |
| EP | 0 808 290 B1 | 12/1998 |
| WO | WO 93/18208 | 9/1993 |

OTHER PUBLICATIONS

Franz Wenisch, et al., The American Institute of Chemical Engineers, vol. 75, No. 185, pp. 14–18, "Experiences with an Undivided Cell", 1979 no month available.

Heinz Nohe, The American Institute of Chemical Engineers, vol. 75, No. 185, pp. 69–75, "Comparison of Conventional and Electro–Organic Processes", 1979 no month available.

D. Degner, "Organic Electrosyntheses in Industry", Topics in Current Chemistry, vol. 148, 1988 no month available.

S. Steckhan, "Organic Syntheses with Electrochemically Regenerable Redox Systems", Topics in Current Chemistry, vol. 142, 1987 no month available.

* cited by examiner

*Primary Examiner*—Edna Wong
(74) *Attorney, Agent, or Firm*—Oblon, Spivak, McClelland, Maier & Neustadt, P.C.

(57) ABSTRACT

One embodiment of the present invention provides a process, which includes:

electrochemically oxidizing at least one organic compound by bringing the organic compound into contact with an anode, wherein the anode includes:

an electrically conductive support; and an electrically conductive, anodically polarized layer on the support;

wherein the anodically polarized layer is formed in situ upon the support by precoating; and wherein the organic compound is not phosphonomethyliminodiacetic acid. Another embodiment of the present invention provides a product, produced by the above process.

28 Claims, No Drawings

PROCESS FOR ELECTROCHEMICAL OXIDATION OF ORGANIC COMPOUNDS

BACKGROUND OF THE INVENTION

1. Field of the Invention

The present invention relates to a process for electrochemical oxidation of organic compounds.

2. Discussion of the Background

Cell types of the most diverse nature are described for oxidation reactions, including the so-called capillary cracking cell, which was developed by Beck and Guthke in 1969. In these cells, electrochemical oxidation reactions take place on graphite electrodes, such as the methoxylation of furan to dimethoxydihydrofuran or the Kolbe electrolysis of adipic acid esters to 1,10-sebacic acid esters. By the use of graphite, particles of graphite can lead to short circuits due to the rough surface and graphite abrasion during electrolysis. Graphite blocks coated with metal foil have proved to be too unstable, since the metal foils wrinkle and split (F. Wenisch, H. Nohe, H. Hannebaum, D. Degner, R. K. Horn, M. Stroczel, *AIChE Symposium Series* 1979, 75, 14; H. Nohe, *AIChE Symposium Series* 1979, 75, 69).

In addition, numerous oxidation reactions of aromatics on graphite are known. For example, a yield of >85% of anisaldehyde dimethylacetal is obtained in the oxidation of p-methoxytoluene on graphite in methanol and KF (D. Degner, *Topics in Current Chemistry* 1988, 148, 3–95).

A large number of mediator-assisted oxidation reactions have also been described (E. Steckhan, *Topics in Current Chemistry* 1987, 142, 3–69). Furthermore, the use of the Ce(III)/Ce(IV) mediator system has industrial importance (WO 93/18208; U.S. Pat. No. 4,794,172 and U.S. Pat. No. 4,639,298).

In addition, it is known from publications on preparative organic electrochemistry that cathodes and anodes used on a preparative scale must have special electrochemical properties. Such electrodes are frequently manufactured by coating metal or carbon-like support electrodes by appropriate coating methods such as plasma sputtering, impregnation and baking, hot pressing, galvanic deposition, etc., as is described in EP 0435434 B.

Furthermore, in German Patent Application 19911746.2 A the manufacture of a diamond-coated electrode is described as well as its use in oxidation reactions of organic compounds.

A disadvantage in such manufacturing processes is that the electrodes must be frequently removed from the electrolysis apparatus and sent to external regeneration after inactivation of the catalytically active layer. Thus, short catalyst service lives and poisoning phenomena rule out economic use of the electrochemical system. A further disadvantage is found in the complex manufacture of the catalytically active layer as such and the achievement of adequate stability of this layer on the support electrode. The development expense for classical electrode-coating processes therefore pays for itself only in very large-scale processes, such as alkali metal chloride electrolysis or dimerization of acrylonitrile.

In European Patent Application 808920 A, a process is described for reduction of organic compounds by bringing the organic compound into contact with a cathode, wherein the cathode includes a support of an electrically conductive material and an electrically conductive, cathodically polarized layer formed in situ thereon by precoating. Oxidation reactions are not described therein. German Patent Application 19954323.2 A relates to the oxidation of phosphonomethyliminodiacetic acid to glyphosates.

SUMMARY OF THE INVENTION

It is an object of the present invention to provide a process for the oxidation of organic compounds, which makes possible high space-time yields.

It is another object of the present invention to provide a process for the oxidation of organic compounds, which makes possible high selectivities for repeatedly oxidized compounds.

It is another object of the present invention to provide a process for the oxidation of organic compounds, which suppresses oxidation of the solvent as much as possible.

It is another object of the present invention to provide a process for the oxidation of organic compounds, which permits high current densities.

It is another object of the present invention to provide a process for the oxidation of organic compounds, which is industrially usable.

The objects of the present invention, and others, may be accomplished with a process, which includes:

electrochemically oxidizing at least one organic compound by bringing the organic compound into contact with an anode, wherein the anode includes:
- an electrically conductive support; and
- an electrically conductive, anodically polarized layer on the support;
- wherein the anodically polarized layer is formed in situ upon the support by precoating; and
- wherein the organic compound is not phosphonomethyliminodiacetic acid.

Another embodiment of the present invention provides a product, produced by the above process.

DESCRIPTION OF THE PREFERRED EMBODIMENTS

Various other objects, features and attendant advantages of the present invention will be more fully appreciated as the same becomes better understood from the following detailed description of the preferred embodiments of the invention.

Preferably, the present invention relates to a process for electrochemical oxidation of at least one organic compound by bringing an organic compound into contact with an anode, characterized in that the anode includes a support of electrically conductive material and an electrically conductive, anodically polarized layer formed in situ thereon by precoating, wherein phosphonomethyliminodiacetic acid is ruled out as the organic compound.

Preferably, the catalytically active electrode is stabilized in the operating condition by the pressure loss at the electrically conductive anodically polarized layer formed by precoating. In this connection the term "in situ" used according to the invention covers all alternative versions of such precoating with the material for the anodically polarized layer, which can therefore take place together with or also after introduction of the reaction mixture into the reactor. The term "in situ" therefore directly expresses the fact that the anode is formed in the oxidation cell and, in fact, by precoating. For regeneration the layer can be resuspended by stopping the pumped circulation and discharged by blowing out. Thus oxidation reactions are performed on a system which is suitable for forming a catalytically active electrode and decomposing it once again in the process, without the need to open the cell or extract electrodes.

Preferable supports for the electrically conductive, anodically polarized layer there include electrically conductive materials. Compared with the reductive processes already described, the oxidative side imposes more stringent requirements on the stability of the material. Suitable materials are platinum or platinized metals, such as platinized titanium. The materials from which the support is made preferably depend on, among other factors, the solvent of the anolyte. Preferably, coated Ti, Ta and/or Nb supports are used. For this purpose there can be mentioned in particular platinized supports or supports provided with mixed oxides of Subgroups IV to VI, with Ru/Ta mixed oxide, with Ru/Ir mixed oxide, with coatings based on Ru oxide (DSA®), with $IrO_2$, with $PbO_2$, with $SnO_2$, with Co oxides or with Ni/Ni oxides (basic pH) or also Fe/Fe oxides (basic pH) or spinels. Furthermore, there can also be used electrode carbon and graphite, from which matching support materials can be prepared by a new machining process, or in other words water-jet cutting. Furthermore, there can also be used fabric forms of graphite or carbon that are commercially available in the form of technical fabric.

Preferably, these supports exist as permeable, porous materials. These can have the form of commercial filter fabrics which include or are composed of metal wires or graphite/carbon fibers, graphite/carbon fabrics and graphite/carbon sponges. Other preferable supports include filter fabrics of the linen weave, twill weave, twilled braiding weave, braiding weave and satin weave type. More preferably, perforated metal foils, metal felts, graphite felts, edge filters, sieves or porous sintered elements can be used as large-surface supports in the form of plates or candles. The pore width is preferably 5 to 300 $\mu$m, and more preferably 50 to 200 $\mu$m. These ranges include all values and subranges therebetween, including 10, 20, 60, 80, 100, 130, 160, 190, 220, 250, 270 and 290 $\mu$m. In constructing the support, it is especially preferred to ensure that it has the largest possible free surface area, so that only small pressure losses have to be overcome during operation of the inventive process.

Supports that are readily usable in the scope of the present process preferably have at least approximately 3% free surface, more preferably 5% and especially approximately 10% free surface, the maximum free surface being approximately 50%. These ranges include all values and subranges therebetween, including 4, 6, 8, 12, 14, 18, 22, 24, 30, 34, 38, 42, 44 and 48%.

As the electrically conductive material for the electrically conductive anodically polarized layer there can be used all electrically conductive and partly conductive materials, provided it is possible to form therefrom, by precoating, a layer on the support.

Preferably, this anodically polarized layer contains at least one metal, at least one metal oxide or at least one carbon-like material, such as carbon, especially active carbon, carbon black or graphite or mixtures of two or more thereof.

As metals there are preferably chosen classical metals and/or metal oxides that are also used for oxidation, especially Mn, Fe, Mo, Co, Ag, Ir, Pt, Os, Cu, Zn, Cr, Pd, V, W, Bi, Ce and/or oxides thereof or mixtures or doped forms thereof. Likewise the salts thereof can be used in low concentration, which salts can be regenerated oxidatively as intermediates.

Preferably, anodically polarized layer includes a metal or oxide from among one or more of the Group I metal, Group VI metal, Group VII metal, Group VIII metal, Group I metal oxide, Group VI metal oxide, Group VII metal oxide, Group VIII metal oxide, and mixtures thereof. The "Group" designation used throughout this application means those groups from the Periodic Table of the Elements, such as that recited in *Handbook of Chemistry and Physics*, 66$^{th}$ ed., CRC Press, Boca Raton, Fla. 1985, the entire contents of which are hereby incorporated by reference.

Preferably, the metals or metal oxides used exist in finely divided and/or activated form.

Preferably, the anodically polarized layer can also be formed by exclusive precoating of the carbon-like material. Above and beyond this, the anode can also be constructed in situ, in that the metals and metal oxides mentioned herein can be precoated on carbon-like materials, especially activated carbon as the support.

Moreover, the metals and/or metal oxides mentioned herein can be precoated on the support, on surfaces such as metals and carbon-like materials, in the form of nanoclusters, the preparation of which is described, for example in German Patent Application 4408512 A, the entire contents of which being hereby incorporated by reference.

Preferably, the anodically polarized layer can contain an electrically conductive auxiliary material, which improves the adhesion of the metals, metal oxides or nanoclusters defined herein to the support or increases the surface area of the anode, in which case electrically conductive oxides such as magnetite, as well as carbon, especially activated carbon, can be mentioned.

In a further preferable embodiment of this process, there is used an anode which is obtained by the fact that the electrically conductive auxiliary material is first precoated on a support, and then this auxiliary material forms the catalytically active layer in situ by oxidation of metals such as Mn, Fe, Mo, Co, Ag, Ir, Cu, Zn, Cr, V, W, Bi. The anode is produced by precoating the metals either directly or after application of the auxiliary material as support.

The mean particle size of the particles forming the layer defined hereinabove, as well as the thickness of the layer, is preferably chosen such that an optimal ratio of filter pressure loss and hydraulic throughout is ensured and optimal mass transport is possible. Preferably, the mean particle size is approximately 1 to approximately 400 $\mu$m, more preferably approximately 30 to 150 $\mu$m, more particularly preferably 40 to 125 $\mu$m, and most preferably 60 to 100 $\mu$m. These ranges include all values and subranges therebetween, including 2, 5, 10, 20, 50, 90, 120, 140, 220, 240, 320, 340, and 380 $\mu$m. Preferably, the thickness of the layer is approximately 0.5 to 20 mm, more preferably 1 to approximately 5 mm, more particularly preferably 1.5 to 4.5 mm, and most preferably 2.5 to 4 mm. These ranges include all values and subranges therebetween, including 0.6, 0.75, 0.9, 1.1, 1.2, 1.8, 2.1, 2.2, 2.8, 4, 6, 8, 10, 12, 14, 16 and 18 mm.

In this connection it must be pointed out that the pore width of the support in the inventive process preferably exceeds the mean particle diameter, and so two or more particles form bridges over the interstices during formation of the layer on the support, with the advantage that no notable hindrance to flow of the solution containing the organic compound to be oxidized results from formation of the layer on the support. Preferably the pore width of the support is approximately two to approximately four times as large as the mean particle size of the particles forming the layer. More preferably, the pore width of the support is 2.5 to 3.5 times as large as the mean particle size of the particles, more particularly preferably from 2.6 to 3.2 times. These ranges include all values and subranges therebetween, including 2.1, 2.2, 2.4, 2.8, 3.1, 3.3, 3.6, 3.8 and 3.9 times. Obviously there can also be used within the scope of the present invention supports with pore widths that are smaller than the mean particle size of the particles forming the layer, although then attention must be paid precisely to the flow hindrance arising from the forming layer.

As already indicated, the anode used according to the invention is formed in situ by precoating with the constituents that form the layer on the electrically conductive support, the solution containing the particles that form the layer flowing through the support until the entire solid content of this solution is precoated or held in place.

On completion of oxidation or during consumption of the catalytically active layer, this can be separated from the support by simple reversal of the flow direction and disposed of or regenerated independently of the reaction. After the spent layer has been removed completely from the system, it is then again possible to precoat the support with the particles that form the layer and to continue oxidation of the organic compound after complete precoating with these particles.

The current densities in the inventive process are preferably approximately 100 to approximately 10,000 $A/m^2$, more preferably approximately 300 to 4,000 $A/m^2$, more particularly preferably 500 to 3,000 $A/m^2$, and most preferably 1,000 to 2,000 $A/m^2$. These ranges include all values and subranges therebetween, including 120, 200, 400, 600, 800, 1100, 1400, 2200, 4200, 5600, 6000, 7000, 8000, and 9000 $A/m^2$.

The throughput of the solution containing the organic compound to be oxidized preferably ranges from 1 to 4000 $m^3/(m^2 \times h)$, more preferably approximately 50 to approximately 1000 $m^3/(m^2 \times h)$, more particularly preferably 100 to 900 $m^3/(m^2 \times h)$, and most preferably 200 to 800 $m^3/(m^2 \times h)$. These ranges include all values and subranges therebetween, including 2, 10, 30, 70, 110, 300, 450, 520, 700, 840, 910, 970, 1100, 1200, 1400, 2200, 2800, 3000, 3200 and 3600$m^3/(m^2 \times h)$.

Preferably, the process is carried out at a system pressure of approximately $1 \times 10^4$ Pa (absolute) to approximately $4 \times 10^6$ Pa, more preferably approximately $4 \times 10^4$ Pa to approximately $1 \times 10^6$ Pa, more particularly preferably $4.5 \times 10^4$ Pa to $5 \times 10^5$ Pa. These ranges include all values and subranges therebetween, including $1.5 \times 10^4$, $2 \times 10^4$, $2.2 \times 10^4$, $3 \times 10^4$, $5 \times 10^4$, $8 \times 10^4$, $1 \times 10^5$, $2 \times 10^5$, $3 \times 10^5$, $6 \times 10^5$, $8 \times 10^5$, $2 \times 10^6$, $3 \times 10^6$ and $3.5 \times 10^6$ Pa.

Preferably, the pressure loss in the layer at the throughputs according to the invention is approximately $1 \times 10^4$ Pa to approximately $2 \times 10^5$ Pa, more preferably approximately $2.5 \times 10^4$ Pa to approximately $7.5 \times 10^4$ Pa, and most preferably $3 \times 10^4$ Pa to $7 \times 10^4$ Pa. These ranges include all values and subranges therebetween, including $1.5 \times 10^4$, $2 \times 10^4$, $2.2 \times 10^4$, $3.2 \times 10^4$, $5 \times 10^4$, $8 \times 10^4$, and $1 \times 10^5$ Pa.

The inventive process is preferably carried out at temperatures between approximately −10° C. to the boiling point of the particular solvent being used, more preferably 0° C. to 70° C., more particularly preferably 5 to 60° C., and most preferably 10 to 50° C. These ranges include all values and subranges therebetween, including −5, −2, 0.5, 3, 4, 10, 15, 20, 25, 30, 35, 40, 55, and 65° C.

Depending on the compound to be oxidized, the inventive process can be performed in acid medium, or at a pH of below 7, preferably −2 to 3, and more preferably 0 to 3; in neutral medium, or at a pH of approximately 7; and in basic medium, or at a pH of above 7, preferably 8 to 14, and more preferably 10 to 14. These ranges include all values and subranges therebetween, including 1, 4, 5, 6, 9, 11, 12, and 13.

Most preferably, the reaction is performed at normal pressure and at 20 to 50° C.

Within the scope of the inventive process, the nature of the cell type used, the shape and arrangement of the electrodes are not particularly limited, and so in principle all cell types that are standard in electrochemistry can be used.

As an example, the following preferable, alternative apparatus versions are mentioned:

(a) Nonpartitioned cells:

Nonpartitioned cells with plane-parallel electrode arrangement or candle-type electrodes are used preferably when neither starting materials nor products are adversely altered by the anode process or react with one another. Preferably the electrodes are disposed in plane-parallel relationship, because in this embodiment a homogeneous current distribution is achieved with small electrode gap (1 mm to 10 mm, preferably 3 mm, which ranges include all values and subranges therebetween, including 2, 4, 5, 6, 7, 8, and 9 mm).

(b) Partitioned cells:

Partitioned cells with plane-parallel electrode arrangement or candle-type electrodes are used preferably when the anolyte must be kept apart from the catholyte in order, for example, to exclude chemical secondary reactions or to simplify the subsequent separation of substances. Preferable partitioning media includes ion-exchange membranes, microporous membranes, diaphragms, filter fabrics of electrically nonconductive materials, sintered glass plates as well as porous ceramics. Preferably ion-exchange membranes are used, especially cation-exchange membranes, among which there are preferably used in turn such membranes that include a copolymer of tetrafluoroethylene and a perfluorinated monomer that contains sulfo groups. The electrodes in partitioned cells are also preferably disposed in plane-parallel relationship, since in this embodiment and small electrode gaps (two gaps of 0 mm to 10 mm each, preferably 0 mm relative to the cathode and 3 mm relative to the anode) there is obtained a homogeneous current distribution. These ranges include all values and subranges therebetween, including 1, 2, 4, 5, 6, 7, 8, and 9 mm. Preferably the partitioning medium is disposed directly on the cathode.

The construction of the cathode is common to both apparatus versions. Preferable electrode material includes perforated materials such as gauzes, expanded metal sheets, lamellas, profiled webs, screens and plain sheet metal. In the plane-parallel electrode arrangement, this construction has the form of plane surfaces, while in the embodiment with candle-type electrodes it has the form of a cylindrical arrangement.

The choice of cathode material or of the coating thereof preferably depends to some extent on the desired cathode reaction. Thus stainless-steel, nickel, nickel-coated or noble-metal-coated electrodes are used for hydrogen formation, while for applications that need a high hydrogen overvoltage there can be considered Pb, Hg, Cd, alloys of Pb/Sn or other metals such as Cu, Ag, steel, Hastelloy®. Furthermore there can be used graphite, conductive ceramics such as $TiO_x$ compounds, Raney nickel, Pt, Pd/C.

Preferable solvents include all protonic solvents, or in other words solvents that contain and can release protons and or can form hydrogen-bridge bonds, such as water, alcohols, amines, carboxylic acids, etc., optionally in mixtures with aprotic polar solvents such as THF. Because of the conductivity that must be maintained, there are preferably used for this purpose lower alcohols such as methanol, ethanol, isopropanol, n-propanol, n-butanol, sec-butanol, tert-butanol, ethers such as diethyl ether, 1,2-dimethoxyethane, furan, THF, MTBE and dimethylformamide, preferably a mixture of these solvents or more preferably water without additives, provided no solubility problems occur for the substances to be converted or the substances being formed.

As preferable alternatives to the alcohols mentioned herein there can also be used carboxylic acids thereof or amides. As carboxylic acids there are preferably used formic acid, acetic acid, propionic acid and longer-chain branched as well as straight-chain carboxylic acids, and also sulfuric acid.

Preferably, the inventive oxidation is performed in the presence of an auxiliary electrolyte.

In dissociatable starting materials to be converted by oxidation, however, it may also be possible in some cases to dispense with the auxiliary electrolytes, provided adequate conductivity exists.

Preferably, an auxiliary electrolyte is used, which is used to adjust the conductivity of the electrolyte solution and/or to control the selectivity of the reaction. The content of the auxiliary electrolyte preferably corresponds to a concentration of approximately 0.1 to approximately 10, more preferably approximately 1 to approximately 5 wt %, in each case relative to the reaction mixture. These ranges include all values and subranges therebetween, including 0.5, 1.4, 1.8, 2, 3, 4, 4.5, 5.1, 6, 7, 8, and 9 wt % relative to the reaction mixture.

Preferable auxiliary electrolytes include protonic acids, such as organic acids, examples of which are methanesulfonic acid, benzenesulfonic acid, acetic acid or toluenesulfonic acid, and inorganic acids, such as sulfuric acid and phosphoric acid. Furthermore, neutral salts can also be used as the auxiliary electrolyte. Preferable cations for this purpose include metal cations such as lithium, sodium, potassium, and also tetralkylammonium cations, such as tetramethylammonium, tetraethylammonium, tetrabutylammonium and dibutyldimethylammonium. Preferable anions include fluoride, tetrafluoroborate, sulfonates such as methylsulfonate, benzenesulfonate, toluenesulfonate, sulfates such as sulfate, methyl sulfate, ethyl sulfate, phosphates such as methyl phosphate, dimethyl phosphate, diphenyl phosphate, hexafluorophosphate, phosphonates such as methylphosphonate methyl ester and phenylphosphonate methyl ester, and also the halides chloride, bromide and iodide. Mixtures are possible.

Basic compounds are also preferably used, such as alkali metal and alkaline earth hydroxides, carbonates, hydrogen carbonates and alcoholates, among which alcoholate anions such as methylate, ethylate, butylate and isopropylate are preferably used. As cations in these basic compounds there can again be considered the cations mentioned above. Mixtures are possible.

Preferable auxiliary electrolyte amines may be used, and preferably those in aqueous solutions or in mixtures of water with organic solvents, examples being ammonia, triethylamine, tri-n-propylamine, isopropylamine, n-propylamine, Hünig's base, butylamine, tributylamine, DABCO and morpholine.

Preferably, the process according to the invention may be performed not only by using a homogeneous solution of the organic compound to be oxidized in a suitable solvent, but also in a two-phase system, which includes one phase containing at least one organic solvent as defined herein and a second, water-containing phase.

The inventive electrochemical oxidation can be performed either continuously or batchwise. In both reaction operations, an anode is first prepared in situ by forming on the support a catalytically active layer by precoating. For this purpose a suspension of the finely divided metal and/or of the metal oxide and/or nanoclusters and/or carbon-like material, or in other words the material with which precoating is to be achieved, is allowed to flow through the support until substantially the entire quantity of material contained in the suspension is disposed on the support. Whether this is the case can be recognized visually, for example, by the fact that the suspension, which was turbid at the beginning of precoating, becomes clear.

If precoating with an intermediate layer is additionally carried out, a suspension of the material forming the intermediate layer is passed through the carrier until substantially the entire quantity introduced is disposed on the support. Thereafter the procedure described above is followed for precoating the material forming the anodically polarized layer.

After preparation of the anode has been completed, the organic compound to be oxidized is then supplied to the system and oxidized by introducing into the system a mass flow accurately defined beforehand. Preferably, by exact control of the supplied mass flow, it is also possible within the scope of the inventive process to isolate partly oxidized compounds.

For complete oxidation of the organic compounds used as starting materials, the selectivities are at least 50%, in general above 70% and, in the case of oxidation reactions that proceed particularly smoothly, greater than 90%. These ranges include all values and subranges therebetween, including 55, 60, 65, 75, 80, and 85%.

During isolation of the synthesized product, it is possible to replace catalyst that may have been consumed by reversing the flow direction in the electrolysis cell, whereby the precoated layer loses contact with the support and, by suction or filtration, for example, the solution or suspension containing it can be removed. Thereafter the layer can be built up again as described hereinabove and then new starting material can be supplied and converted.

Furthermore, the steps of conversion (oxidation), regeneration of the catalyst or renewed conversion of a starting material can also be performed in alternation, in that firstly the anode is prepared in situ by precoating as described hereinabove, then the organic compound to be oxidized is supplied and converted, on completion of conversion the flow direction in the electrolysis cell is changed and the spent catalyst is removed, for example by filtration, after which the anode is built up again with fresh material that forms the anodically polarized layer and then oxidation is resumed.

Obviously this alternation between conversion, removal of the spent layer and renewal of the anode can be repeated an arbitrary number of times, with the result that the inventive process can be performed not only batchwise but also continuously, thus leading in particular to extremely short stoppage times for regeneration or replacement of the catalyst.

In another preferred embodiment of the inventive process, the electrolysis unit, which includes at least one anode with a common anolyte circulation, is operated in steady state as a homogeneously continuous reactor. This means that a well-defined concentration level of starting materials and products is maintained after one-time precoating with the catalyst. For this purpose the reaction solution is continuously pumped in circulation over the electrochemically active anode and starting material is continuously supplied to the circulation. At the same time, product is continuously removed from this circulation, so that the reactor contents remain constant in time. The advantage of this process operation compared with batchwise reaction operation is a simpler process operation with less complex apparatus. The reaction-related disadvantage that either unfavorable concentration ratios (such as low starting material concentration and high product concentration at the end point of the reaction) or more complex separation techniques for working up must be tolerated can be countered with the following apparatus configuration, which is particularly preferred:

Preferably, at least two electrolysis units are connected in series, starting material being supplied to the first unit and the product being removed from the last unit. By this operating principle it is ensured that operation will take place with much lower concentration profiles in the first electrolysis unit or units than in the last unit or units. Averaged over all electrolysis units, therefore, higher space-time yields are achieved compared with a reaction operation in which the electrolysis units.; are operated in a parallel arrangement.

This cascade arrangement of the electrolysis units is especially preferable, in particular when the required production capacity necessitates the installation of multiple electrolysis units in any case.

In principle all organic compounds with electrochemically oxidizable groups can be used as starting materials as the organic compounds in the inventive process. Furthermore, both completely and also partly oxidized compounds can be obtained as products, depending on the total mass flow supplied. As an example, starting from an alcohol, not only the corresponding aldehyde but also the carboxylic acid oxidized correspondingly to completion can be obtained.

Preferred electrochemical oxidation reactions according to the invention are the formation of alcohols, ethers, ketones, aldehydes, epoxides, carboxylic acids, esters, olefins, amides, azo compounds and oxo amides. Another preferred reaction is halogenation, especially fluorination, chlorination, bromination, and especially preferably bromination.

A preferred embodiment includes the oxidation of one or more aromatics such as substituted benzenes, substituted toluenes and substituted or unsubstituted naphthalenes. Very generally, there can be converted under such conditions aromatics of the following formula:

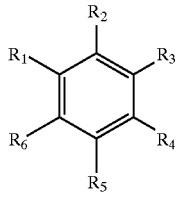

wherein $R_1$, $R_2$, $R_3$, $R_4$, $R_5$ and $R_6$, independently of one another, are each H; alkyl; aryl; OR, with R=H, alkyl, aryl, CO—R', with R'=alkyl and aryl; COOR, wherein R=H, alkyl, or aryl; COR, wherein R=alkyl, or aryl, nitro; F, Cl, Br, I; CONR'R", wherein R' and R" can independently of one another be alkyl, aryl, alkyloxymethylene, aryloxymethylene, alkyloxyethylene, aryloxyethylene; NR'R", with R' and R", independently of one another, =H, alkyl, aryl, alkyloxymethylene, aryloxymethylene, alkyloxyethylene or aryloxyethylene; wherein $R_1$, and $R_2$ or $R_4$ and $R_5$ can be parts of a further condensed ring system, which can be aromatic or heteroaromatic. The alkyl chains can be branched or unbranched. Mixtures are possible. Especially preferred in this embodiment are processes for alkoxylation, preferably methoxylation of 4-methoxytoluene, p-xylene, p-tert-butyltoluene, 2-methylnaphthalene, anisole or hydroquinone dimethyl ether. Also preferred is the conversion of toluene and benzene derivatives, such as chlorobenzene, 1,2-dichlorobenzene, 1,3-dichlorobenzene, 1,4-dichlorobenzene and, by analogy, the fluorinated, brominated and iodinated benzenes. Further substrates are fluorotoluenes, chlorotoluenes, bromotoluenes and iodotoluenes, which can be substituted at the ortho, meta and para positions, and also nitrobenzenes or nitrotoluenes, especially nitrobenzene, m-dinitrobenzene, o-dinitrobenzene, p-dinitrobenzene, m-nitrotoluene, o-nitrotoluene, p-nitrotoluene, 2,4-dinitrotoluene and 2,6-dinitrotoluene, or monoacetyl-substituted toluenes, monoacetyl-substituted benzenes, bisacetyl-substituted toluenes and bisacetyl-substituted benzenes.

In the formula above, the alkyl groups are preferably branched or unbranched $C_{1-20}$ alkyl, more preferably $C_{2-10}$ alkyl, more particularly preferably $C_{3-7}$ alkyl, which ranges include all carbon values and subranges therebetween, including those having 4, 5, 6, 8, 9, 11, 12, 13, 14, 15, 16, 17, 18, and 19 carbons. In the formula above, the aryl groups are preferably $C_{6-22}$, and more preferably $C_{10-14}$, which ranges include all carbon values and subranges therebetween, including those having 7, 8, 9, 11, 12, 13, 15, 16, 17, 18, 19, 20, and 21 carbon atoms. In the formula above, the heteroaromatic groups may include one or more heteroatoms such as O, N, S and combinations thereof.

The organic compounds mentioned hereinabove can also be acyloxylated by the process for electrochemical oxidation, in which case acetic acid in particular is used as solvent.

Another preferred embodiment of the process relates to the anodic dimerization of substituted and unsubstituted benzenes, toluenes and naphthalenes, in which case the organic compounds mentioned hereinabove are preferably substituted with $C_1$ to $C_5$ alkyl chains. The inventive process can also be used advantageously for alkoxylation, preferably methoxylation or hydroxylation of carbonyl compounds, especially of cyclohexanone, acetone, butanone or substituted benzophenones.

Another preferred embodiment is the oxidation of alcohols or carbonyl compounds to carboxylic acids, especially of butanediol to acetylenedicarboxylic acid or of propargyl alcohol to propiolic acid.

Also preferred is the Kolbe reaction, the electrochemical decarboxylation of aliphatic carboxylic acids for coupling of carboxylic acid groups, which may also be substituted, for synthesis of acids, alkanes or for more advanced synthesis of alcohols, ethers, diesters, monocarboxylic acids, dicarboxylic acids and compounds induced by radicals. Another preferred embodiment is the conversion of open-chain and cyclic hydrocarbons, in order to obtain products methoxylated and doubly methoxylated in allyl position. In this regard, especially preferred is the synthesis of cyclohex-2-enyl methyl ether or 1,1-dimethoxy-2-cyclohexane, starting from cyclohexane.

The process can also be used advantageously for functionalization of amides.

Particularly suitable amides are represented by the formula (I)

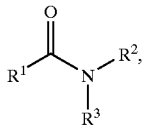

(I)

where $R_1$ is a branched or straight-chain $C_1$ to $C_{20}$ alkyl, cycloalkyl, or aralkyl group, and $R^2$ or $R^3$ independently of one another denote a $C_1$ to $C_{20}$ alkyl group. In the formula (I) above, the alkyl groups are preferably branched or unbranched $C_{2-10}$ alkyl, and more preferably $C_{3-7}$ alkyl, which ranges include all carbon values and subranges therebetween, including those having 4, 5, 6, 7, 8, 9, 11, 12, 13, 14, 15, 16, 17, 18, and 19 carbons. Mixtures are possible. Alkoxylation is the most preferred functionalization reaction. In an especially preferred reaction, dimethylformamide is converted to N-monomethoxymethyl-N-methylforrnamide.

Another preferred embodiment of the inventive process is oxidation of heterocyclics. Preferred heterocyclics contain 3 to 7, preferably 4 to 6 and especially preferably 4 to 5 carbon atoms. The heterocyclics can contain 1 to 3, preferably 1 to 2 and especially preferably 1 hetero group or hetero atom. Preferred hetero groups or hetero atoms are such that contain NH, O or S. It is further preferred that the heterocyclics have at least one double bond, preferably two double bonds. Furthermore, the heterocyclics can be substituted, halogens, chlorine, bromine, iodine, fluorine, and $C_1$ to $C_{20}$ alkyl groups being particularly preferred substituents. As electrochemical conversion reactions of heterocyclics there are preferred in particular the conversion of tetrahydrofuran to 2-monomethoxytetrahydrofuran and 2,5-dimethoxytetrahydrofuran, or of furan to dimethoxydihydrofuran, as well as the conversion of N-methylpyrrolidone-2 to 5-methoxy-N-methylpyrrolidone-2. Also preferred is the oxidation of hydrazines to the corresponding azo compounds; especially preferably, isopropyl-, ethyl- and tert-butylhydrazodicarboxylate are converted to the corresponding azodicarboxylic acid esters.

Thus the present invention preferably relates in particular to a process of the type described here, in which one or more of the following oxidation reactions/conversion reactions take place:

oxidation of at least one alcohol and/or at least one carbonyl compound to at least one carboxylic acid or at least one carboxylic acid ester;

acetoxylation reactions;

alkoxylation of alkylaromatics; p-xylene, p-methoxytoluene, p-tert-butyltoluene, p-chlorotoluene, p-isopropyltoluene; acetone, methyl ethyl ketone, cyclohexanone, methylglyoxal dimethylacetal; ethyl-, isopropyl-, tert-butylhydrazodicarboxylate; sebacic acid dimethyl ester; $Ce^{3+/4+}$, $Cr^{3+/6+}$; conversion of open-chain or cyclic hydrocarbons to products monoalkoxylated or dialkoxylated in allyl position;

conversions of ketones to compounds hydroxylated in a-position;

electrochemical decarboxylation of at least one aliphatic carboxylic acid to obtain at least one alkane and/or alcohol and/or ether and/or ester, diesters and/or monocarboxylic acid and/or dicarboxylic acid;

electrochemical oxidation or functionalization of at least one heterocyclic compound;

functionalization of at least one amide;

halogenation of at least one aliphatic, aromatic or araliphatic hydrocarbon.

Also preferred is the electrochemical oxidation of metal salts that can be used as mediators in or outside the cell. Especially preferred for this purpose is the use of the ion pair $Ce^{3+/4+}$and/or $Cr^{3+/6+}$.

Preferably, the following compounds are oxidized:

p-xylene, p-methoxytoluene, p-tert-butyltoluene, p-chlorotoluene, p-isopropyltoluene; acetone, methyl ethyl ketone, cyclohexanone, methylglyoxal dimethylacetal; ethyl-, isopropyl-, tertbutylhydrazodicarboxylate; sebacic acid dimethyl ester; $Ce^{3+/4+}$, $Cr^{3+/6+}$. Mixtures are possible.

EXAMPLES

Having generally described this invention, a further understanding can be obtained by reference to certain specific examples which are provided herein for purposes of illustration only and are not intended to be limiting unless otherwise specified.

Example 1

Electrolysis cell: nonpartitioned electrolysis cell of the flow type

Cathode: graphite measuring 100 $cm^2$

Anode: armored braiding of graphite measuring 100 $cm^2$, pore depth 100 $\mu$m

Flow: 20 1/h through the anode

The electrolyte contained a mixture of 1166.7 g of 7% sodium methyl sulfate solution in methanol, 70 g of p-methoxytoluene and 20 g of graphite powder BA 1200, 10 g of Sigradur K (20 to 50 $\mu$m). The conversion was carried out as follows:

Firstly the cell was filled and heated to 40° C., then the graphite material was added and pumped for about 10 minutes, in order to obtain a filter layer as the electrode. Thereafter the electrolysis was performed at a temperature of 40° C. with a current density of 300 $A/m^2$ at normal pressure. The electrolysis was stopped after 4.5 F. After the solvent had been distilled off and the product mixture distilled, there was obtained 79% anisaldehyde. The conversion was 90%.

Example 2

Electrolysis cell: nonpartitioned electrolysis cell of the flow type

Cathode: graphite measuring 100 $cm^2$

Anode: armored braiding of graphite measuring 100 $cm^2$, pore depth 100 $\mu$m

Flow: 20 1/h through the anode

The electrolyte contained a mixture of 1281 g of methanol, 7 g of water, 42 g of potassium iodide, 70 g of methylglyoxal dimethylacetal and 20 g of graphite powder BA 1200, 10 g of Sigradur K (20 to 50 $\mu$m). The conversion was carried out as follows:

Firstly the cell was filled and heated to 40° C., then the graphite material was added and pumped for about 10 minutes, in order to obtain a filter layer as the electrode. Thereafter the electrolysis was performed at a temperature of 10° C. with a current density of 1000 $A/m^2$ at normal pressure. The electrolysis was stopped after 3 F. There was obtained 27% tetramethoxypropanol.

Example 3

Electrolysis cell: nonpartitioned electrolysis cell of the flow type

Cathode: graphite measuring 100 $cm^2$

Anode: armored braiding of graphite measuring 100 $cm^2$, pore depth 100 $\mu m$ Flow: 20 1/h through the anode The electrolyte contained a mixture of 1281 g of methanol, 7 g of water, 42 g of potassium iodide, 70 g of methylglyoxal dimethylacetal, 600 mg of nickel(II) sulfate, 20 g of graphite powder BA 1200, 10 g of Sigradur K (20 to 50 $\mu m$). The conversion was carried out as follows:

Firstly the cell was filled, and then the graphite material was added and pumped for about 10 minutes, in order to obtain a filter layer as the electrode. Thereafter the electrolysis was performed at a temperature of 10° C. with a current density of 1000 $A/m^2$ at normal pressure. The electrolysis was stopped after 3 F. There was obtained 54% tetramethoxypropanol.

This application is based on German patent application No. 19962102.0, filed Dec. 22, 1999, the entire contents of which are hereby incorporated by reference, the same as if set forth at length.

Having now fully described this invention, it will be apparent to one of ordinary skill in the art that many changes and modifications can be made thereto without departing from the spirit or scope of the invention as set forth herein.

What is claimed is:

1. A process, comprising:

electrochemically oxidizing at least one organic compound by bringing said organic compound into contact with an anode, wherein said anode comprises:

an electrically conductive support; and an electrically conductive, anodically polarized layer on said support;

wherein said anodically polarized layer is formed in situ upon said support by precoating; and wherein said organic compound is not phosphonomethyliminodiacetic acid.

2. The process according to claim 1, wherein said anodically polarized layer comprises at least one electrically conductive material selected from the group consisting of metal, metal oxide, activated carbon, carbon black, graphite, and mixtures thereof.

3. The process according to claim 1, wherein said anodically polarized layer comprises at lease one electrically conductive material selected from the group consisting of Group I metal, Group VI metal, Group VII metal, Group VIII metal, Group I metal oxide, Group VI metal oxide, Group VII metal oxide, Group VIII metal oxide, and mixtures thereof.

4. The process according to claim 1, wherein said anodically polarized layer comprises at least one electrically conductive material selected from the group consisting of metal, metal oxide, and mixtures thereof, and wherein said support comprises activated carbon.

5. The process according to claim 1, wherein said support comprises one or more permeable pores.

6. The process according to claim 1, wherein said anodically polarized layer comprises at least one electrically conductive material selected from the group consisting of Mn, Fe, Mo, Co, Ag, Ir, Pt, Os, Cu, Zn, Cr, Pd, V, W, Bi, Ce, Mn oxide, Fe oxide, Mo oxide, Co oxide, Ag oxide, Ir oxide, Pt oxide, Os oxide, Cu oxide, Zn oxide, Cr oxide, Pd oxide, V oxide, W oxide, Bi oxide, Ce oxide, and mixtures thereof.

7. The process according to claim 1, wherein said support comprises at least one electrically conductive material selected from the group consisting of platinum, platinized metal, platinized titanium, coated Ti, coated Ta, coated Nb, Group IV mixed oxide, Group V mixed oxide, Group VI mixed oxide, Ru/Ta mixed oxide, Ru/Ir mixed oxide, Ru oxide, $IrO_2$, $PbO_2$, $SnO_2$, Co oxide, Ni/Ni oxide, Fe/Fe oxide, spinels, electrode carbon, graphite, graphitic fabric, carbon fabric, technical fabric, and mixtures thereof.

8. The process according to claim 1, wherein said support is in the form of at least one permeable or porous material selected from the group consisting of commercial filter fabric, metal wire, graphite/carbon fiber, graphite/carbon fabric, graphite/carbon sponge, linen weave, twill weave, twilled braiding weave, braiding weave, satin weave, perforated metal foil, metal felt, graphite felt, edge filters, sieve element, porous sintered element, large-surface support plate, large-surface support candle, and combinations thereof.

9. The process according to claim 1, wherein said support comprises one or more pores having a pore width of 5 to 300 $\mu m$.

10. The process according to claim 1, wherein said support comprises at least 3% free surface.

11. The process according to claim 1, wherein said anodically polarized layer comprises at least one electrically conductive material in a form selected from the group consisting of particles, activated, nanocluster, and combinations thereof.

12. The process according to claim 1, wherein said anodically polarized layer further comprises at least one auxiliary material selected from the group consisting of magnetite, carbon, activated carbon, and combinations thereof.

13. The process according to claim 1, wherein said precoating comprises flowing a solution or suspension through said support, and wherein said solution or suspension comprises at least one electrically conductive material comprised in said anodically polarized layer.

14. The process according to claim 1, wherein said oxidizing comprises flowing said organic compound through said anode.

15. The process according to claim 1, wherein said organic compound is in contact with a protonic solvent.

16. The process according to claim 1, wherein said organic compound is in contact with an auxiliary electrolyte.

17. The process according to claim 1, wherein said oxidation is carried out batchwise or continuously.

18. The process according to claim 1, wherein said anode further comprises an intermediate layer between said support and said anodically polarized layer.

19. The process according to claim 1, wherein said oxidizing is carried out at a current density of 100 to 10,000 $A/m^2$.

20. The process according to claim 1, wherein said organic compound is in solution, and wherein said oxidizing is carried out at a throughput of said solution of 1 to 4,000 $m^3/(m^2 \times h)$.

21. The process according to claim 1, wherein said oxidizing is carried out at a system pressure of $1 \times 10^4$ Pa to $4 \times 10^6$ Pa absolute.

22. The process according to claim 1, wherein said organic compound is in contact with a solvent, and wherein said oxidizing is carried out at a temperature ranging from −10° C. to a boiling point of said solvent.

23. The process according to claim 1, wherein said anodically polarized layer comprises particles of an electrically conductive material, said particles having a mean particle size of 1 to 400 $\mu m$.

24. The process according to claim 1, wherein said anodically polarized layer has a thickness of 0.5 to 20 mm.

25. The process according to claim 1, wherein said organic compound comprises one or more aromatics of the following formula:

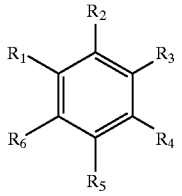

wherein $R_1$, $R_2$, $R_3$, $R_4$, $R_5$ and $R_6$, independently of one another, are each H; branched or unbranched alkyl; aryl; OR, with R═H, branched or unbranched alkyl, aryl, CO—R', with R'=branched or unbranched alkyl and aryl; COOR, wherein R═H, branched or unbranched alkyl, or aryl; COR, wherein R=branched or unbranched alkyl, or aryl, nitro; F, Cl, Br, I; CONR'R", wherein R' and R" are independently of one another branched or unbranched alkyl, aryl, alkyloxymethylene, aryloxymethylene, alkyloxyethylene, aryloxyethylene; NR'R", wherein R' and R" are independently of one another H, branched or unbranched alkyl, aryl, alkyloxymethylene, aryloxymethylene, alkyloxyethylene or aryloxyethylene; and wherein $R_1$ and $R_2$ or $R_4$ and $R_5$, or both $R_1$and $R_2$ and $R_4$ and $R_5$ are, independently of one another, optionally comprised within one or more aromatic or heteroaromatic rings.

26. The process according to claim 1, wherein said oxidizing comprises functionalizing one or more amides having the following formula (1):

(I)

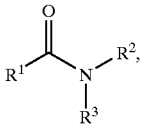

where R' is a branched or straight-chain $C_1$ to $C_{20}$ alkyl, cycloalkyl, or aralkyl group, and $R^2$ or $R^3$ independently of one another denote a $C_1$ to $C_{20}$ alkyl group.

27. The process according to claim 1, wherein said oxidizing comprises at least one reaction selected from the group consisting of:

oxidation of at least one hydrocarbon to an alcohol or to an ether;

oxidation of at least one hydrocarbon and/or at least one alcohol to a carbonyl compound;

oxidation of at least one alcohol and/or at least one carbonyl compound to at least one carboxylic acid or at least one carboxylic acid ester;

acetoxylation;

alkoxylation of one or more alkylaromatics;

conversion of open-chain or cyclic hydrocarbons to one or more products that are monoalkoxylated or dialkoxylated in an allyl position thereof;

conversion of ketones to one or more compounds that are hydroxylated in an α-position thereof;

electrochemical decarboxylation of at least one aliphatic carboxylic acid to obtain at least one alkane and/or alcohol and/or ether and/or ester, diester and/or monocarboxylic acid and/or dicarboxylic acid;

electrochemical oxidation or functionalization of at least one heterocyclic compound;

functionalization of at least one amide;

halogenation of at least one aliphatic, aromatic or araliphatic hydrocarbon;

electrochemical oxidation of one or more metal salts used as mediators for regeneration; and combinations thereof.

28. The process according to claim 1, wherein said oxidizing comprises oxidizing at least one compound selected from the group consisting of p-xylene, p-methoxytoluene, p-tert-butyltoluene, p-chlorotoluene, p-isopropyltoluene; acetone, methyl ethyl ketone, cyclohexanone, methylglyoxal dimethylacetal; ethylbutylhydrazodicarboxylate, isopropylbutylhydrazodicarboxylate, tert-butylhydrazodicarboxylate; sebacic acid dimethyl ester; $Ce^{3+/4+}$, $Cr^{3+/6+}$; and combinations thereof.

* * * * *